United States Patent [19]

Bytheway

[11] 3,991,510

[45] Nov. 16, 1976

[54] TOY EXERCISING DEVICE

[76] Inventor: Jay W. Bytheway, 865 Lucy Ave., Salt Lake City, Utah 84104

[22] Filed: Aug. 4, 1975

[21] Appl. No.: 601,583

[52] U.S. Cl. ..... 46/1 R; 272/93; 46/47

[51] Int. Cl.[2] ..... A63H 33/00

[58] Field of Search ..... 46/1 R, 47; 272/83 R; 273/109

[56] References Cited

UNITED STATES PATENTS

| | | | |
|---|---|---|---|
| 2,817,184 | 12/1957 | Inouye | 273/109 |
| 3,545,121 | 12/1970 | Misko | 46/1 |
| 3,761,083 | 9/1973 | Buchner | 272/83 R |

*Primary Examiner*—Louis G. Mancene
*Assistant Examiner*—Robert F. Cutting

[57] ABSTRACT

A toy for operator enjoyment and demonstration of skill is disclosed. The toy is capable of transferring the kinetic energy of the operator's hand motion into a small mass which transverses a rod from one end to the other in a cyclic manner. The kinetic energy imparted to the mass is partially stored and released at each end of the rod as the mass impacts stops and reverses direction of motion. The cyclic action of the mass is dependent upon its energy storing and releasing ability at the stops and the operator's skill to impart additional energy to the mass.

5 Claims, 2 Drawing Figures

TOY EXERCISING DEVICE

SUMMARY OF INVENTION

In the present invention there is provided a novel toy that permits the operator to demonstrate his skill. The toy of the present invention incorporates a rod, two end stops, and a small mass capable of storing and releasing energy.

The rod serves as the path and physical contraints for the motion of the mass. The stops which are secured at each end of the rod limit the travel of the small mass. These stops also serve as handles for the toy. An energy storage and releasing device is employed to store the kinetic energy of the small mass as it impacts the stops attached at each end of the rod. The recoverable stored energy plus that imparted by the operator is transmitted to the mass as it starts to move in the opposite direction, thus causing the mass to oscillate back and forth between the two end stops. The operation of the toy is dependent upon the operator's ability to move his hand or hands at a frequency and amplitude that will allow the mass to oscillate in the manner described.

In operation, the toy is held in several different positions to provide entertainment and to demonstrate the skill of the operator. Either one handle or both handles of the toy are held as the operator attempts to transmit energy to the small mass of the toy. Wrist action of the hand or motion of the hand in line with the axis of the rod are the two most common motions for initiating and repeating the cyclic action during one handed operation. Two handed operation requires the hands to be moved in opposite directions in a cyclic motion. This is usually accomplished by bending the rod so it forms an arch. It may also be accomplished by extending the arms and keeping the rod straight. The operator's ability to impart cyclic motion to the small mass in an uninterrupted rhythmic manner in the various modes of operation demonstrates his ability to successfully operate the toy. Additional entertainment to the operator and those observing is achieved in dark or semi dark areas by using illuminous or highly reflective part for the oscillating mass.

DESCRIPTION OF THE PREFERRED EMBODIMENT

Figure 1:
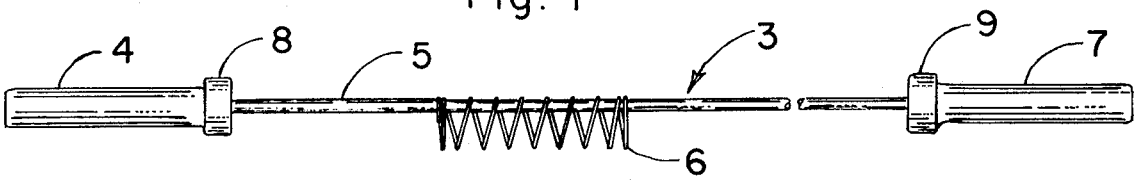
FIG. 1 is an illustration of a novel toy of the present invention.

With particular reference to FIG. 1 there is presented an illustration of the novel toy assembly of the present design. Toy assembly 3 includes a round flexible rod 5 to which are attached two handles 4 and 7. The rod 5 may be formed from 3/16 inch diameter polypropylene plastic, but other suitably flexible material may be used. The handles 4 and 7 may be molded from polyethylene plastic and press fit or otherwise affixed to the ends of the rod 5. A coil spring 6 of a predetermined mass and spring constant is captured on the rod 5 and between the end stops 8 and 9 integrally formed on the inward ends of the handles. The spring 6 serves as the oscillating mass and the energy storing device.

Figure 2:
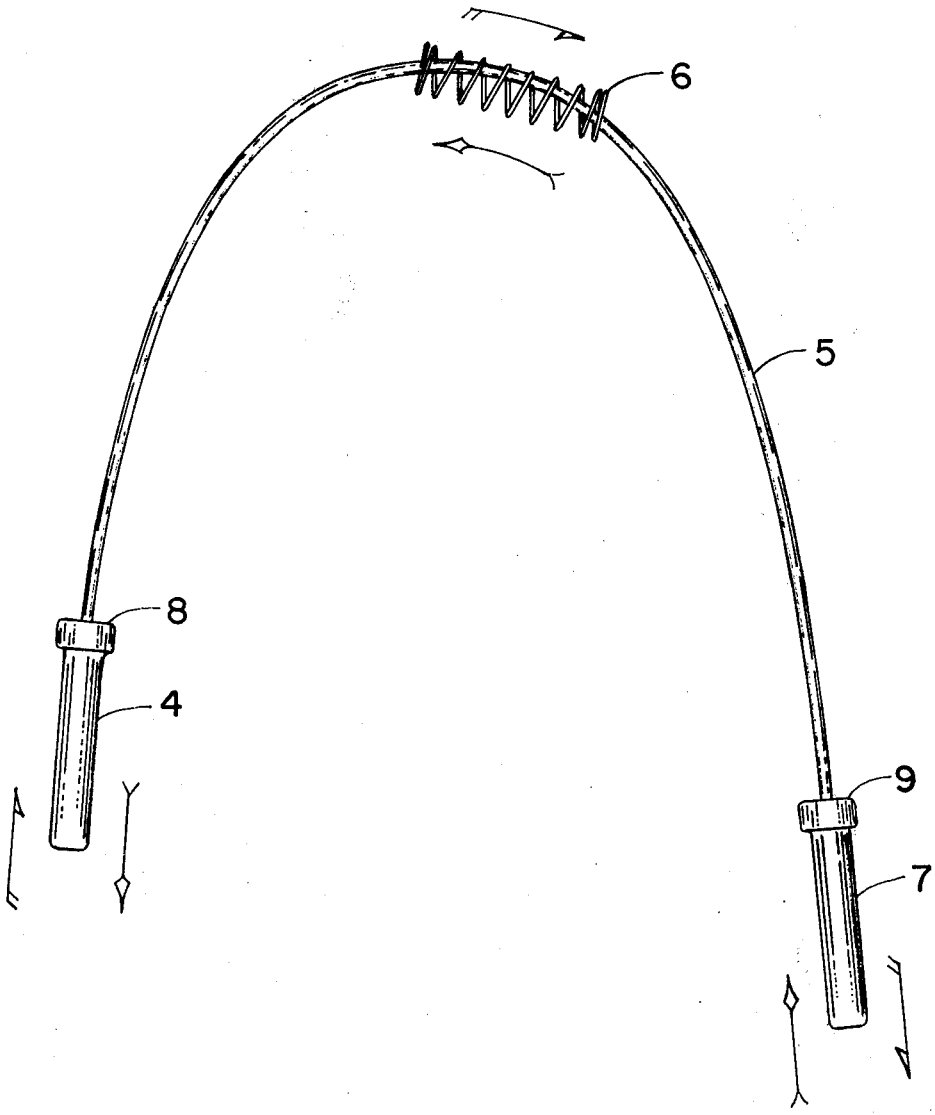
FIG. 2 is an illustration of the toy of the present invention for two handed operation.

In normal operation, the spring 6 may be made to oscillate between the end stops 8 and 9 in several different modes of operation. FIG. 2 illustrates a two handed mode of operation. As the spring 6 impacts end stop 8, handle 7 is lowered and handle 4 is elevated as indicated by the arrows in the drawing thus imparting additional energy to the spring's mass. This added energy allows the mass to move up and over the highest part of the arched rod. As the spring 6 drops and impacts end stop 9 handle 4 is lowered and handle 7 elevated. The above action is repeated as the spring 6 oscillates between the two end stops 8 and 9.

It is also possible to cause the mass 6 to oscillate between stops 8 and 9 using only one hand to grip one handle if a proper combination of wrist action and arm thrust are employed. Alternatively, because the rod 5 is quite flexible, both handles can be grasped in one hand to form a loop and then again with proper wrist action and arm thrust the mass 6 can be made to bounce back and forth between stops.

I claim:

1. A toy, comprising:

a flexible rod;

stop means attached to each end of said rod; and a coil spring having an inside diameter greater than the diameter of said rod and disposed in encircling relation on said rod.

2. The toy of claim 1 wherein the said spring freely moves between said stops.

3. Apparatus as in claim 1 wherein said stop means comprises:

first and second cylindrical members having a bore formed in one end thereof into which the ends of said rod may pass, and as integrally formed enlargement at the end of said members in which said bore is formed, said enlargement having a cross-sectional dimension greater than the diameter of said coil spring.

4. The toy of claim 1 wherein the said spring is coated with a luminous material.

5. The toy of claim 1 wherein the said spring has a reflective surface.

* * * * *